US009486666B2

(12) United States Patent
Singh

(10) Patent No.: US 9,486,666 B2
(45) Date of Patent: Nov. 8, 2016

(54) ROWING SIMULATOR

(71) Applicant: BASIX INTERNATIONAL INC., Toronto (CA)

(72) Inventor: Satinder Singh, Toronto (CA)

( * ) Notice: Subject to any disclaimer, the term of this patent is extended or adjusted under 35 U.S.C. 154(b) by 174 days.

(21) Appl. No.: 14/272,307

(22) Filed: May 7, 2014

(65) Prior Publication Data

US 2014/0336011 A1 Nov. 13, 2014

Related U.S. Application Data

(60) Provisional application No. 61/820,347, filed on May 7, 2013.

(51) Int. Cl.

| | |
|---|---|
| ***A63B 69/06*** | (2006.01) |
| ***A63B 22/00*** | (2006.01) |
| *A63B 21/005* | (2006.01) |
| *A63B 21/008* | (2006.01) |
| *A63B 21/012* | (2006.01) |
| *A63B 21/00* | (2006.01) |
| *A63B 21/22* | (2006.01) |

(52) U.S. Cl.

CPC ..... *A63B 22/0076* (2013.01); *A63B 22/0087* (2013.01); *A63B 69/06* (2013.01); *A63B 21/008* (2013.01); *A63B 21/0051* (2013.01); *A63B 21/012* (2013.01); *A63B 21/157* (2013.01); *A63B 21/225* (2013.01); *A63B 2022/0082* (2013.01); *A63B 2069/064* (2013.01)

(58) Field of Classification Search

CPC ..... A63B 22/0076; A63B 22/0087; A63B 21/0051; A63B 21/157; A63B 21/225; A63B 69/06; A63B 2069/062–2069/068; G09B 19/03; G09B 19/0038

USPC ..... 434/29, 247–258

See application file for complete search history.

(56) References Cited

U.S. PATENT DOCUMENTS

| | | | | | |
|---|---|---|---|---|---|
| 1,401,038 | A * | 12/1921 | Britt | A63B 22/0076 | 482/72 |
| 1,504,375 | A * | 8/1924 | Phillips | A63B 22/0076 | 482/112 |
| 3,528,653 | A * | 9/1970 | Ross | A63B 21/015 | 482/118 |
| 3,912,264 | A * | 10/1975 | Busse | A63B 21/157 | 482/118 |
| 4,690,398 | A * | 9/1987 | Smith | A63B 21/0083 | 482/73 |
| 4,743,011 | A * | 5/1988 | Coffey | A63B 21/0088 | 482/111 |
| 4,984,986 | A * | 1/1991 | Vohnout | A63B 24/00 | 434/247 |
| 5,441,469 | A * | 8/1995 | Chern | A63B 22/0076 | 482/72 |
| 7,022,052 | B1 * | 4/2006 | Lai | A63B 21/0083 | 482/72 |
| 7,500,938 | B2 * | 3/2009 | Fan | A63B 22/0076 | 482/72 |
| 7,572,211 | B2 * | 8/2009 | Roach | A63B 22/0076 | 482/51 |
| 7,828,706 | B2 * | 11/2010 | Medina | A63B 22/0076 | 482/148 |
| 7,833,136 | B2 * | 11/2010 | Bell | A63B 21/154 | 482/138 |
| 7,862,484 | B1 * | 1/2011 | Coffey | A63B 21/157 | 482/72 |
| 9,005,086 | B1 * | 4/2015 | O'Neil | A63B 22/0076 | 482/51 |
| 2003/0166434 | A1 * | 9/2003 | Lopez-Santillana | A63B 21/0053 | 482/52 |

FOREIGN PATENT DOCUMENTS

| | | |
|---|---|---|
| GB | 2492951 A | 1/2013 |

OTHER PUBLICATIONS

International Search Report (Jul. 22, 2014).

* cited by examiner

*Primary Examiner* — Oren Ginsberg
*Assistant Examiner* — Gregory Winter
(74) *Attorney, Agent, or Firm* — Sabeta IP

(57) ABSTRACT

A rowing apparatus having: a frame; a seat slidably mounted on the frame; an outrigger for receiving oars; at least one drive mechanism coupled to the outrigger to translate a force applied to the oars to a flywheel having a magnetic break for providing variable resistance; the rowing apparatus having a one way clutch for unidirectional rotary drive of the flywheel, and allowing for operation in a sweeping mode or a sculling mode; and whereby the opposing motions of the oars are combined into a single motion to drive the flywheel.

16 Claims, 7 Drawing Sheets

ROWING SIMULATOR

CROSS-REFERENCE TO RELATED APPLICATIONS

This application claims the benefit of priority to U.S. Provisional Application Ser. No. 61/820,347, filed on May 7, 2013

FIELD OF THE INVENTION

The present invention relates to exercise or training equipment, and more particularly it relates to a rowing apparatus.

DESCRIPTION OF THE RELATED ART

Rowing simulators are well known in the art; they provide dry land training for rowers, and also improve cardiovascular endurance, muscular stamina, muscular power and overall fitness. For example, rowing simulators allow rowers to practice good blade work and help to provide quantitative feedback on performance. A typical rowing simulator is stationary, and includes a flywheel with a plurality of fan-type blades. A handle is connected to the flywheel via a chain or belt, and propels the flywheel when pulled. Existing rowing simulators offer resistance to the simulated rowing motion either by a rotating air paddle in a housing with variable inlets and outlets which can be adjusted to vary the resistance, or by a rotating water paddle arrangement or by magnetic resistance. The existing rowing simulators are complicated, bulky, expensive, and often noisy.

It is thus an object of the present invention to mitigate or obviate at least one of the above-mentioned disadvantages.

SUMMARY OF THE INVENTION

In one of its aspects, there is provided a rowing apparatus having:

a frame;

a seat slidably mounted on said frame;

an outrigger for receiving oars;

at least one drive mechanism coupled to said outrigger to translate a force applied to said oars to a flywheel having resistance means for providing variable resistance;

said rowing apparatus having a one way clutch for unidirectional rotary drive of said flywheel, and allowing for operation in a sweeping mode or a sculling mode; and whereby the opposing motions of said oars are combined into a single motion to drive said flywheel.

In another of its aspects, there is provided a rowing apparatus having:

a frame;

a seat slidably mounted on said frame;

an outrigger for receiving oars;

at least one drive mechanism coupled to said outrigger to translate a force applied to said oars to a flywheel having resistance means;

a one way clutch for unidirectional rotary drive of the flywheel, and allowing for operation in a sweeping mode or a sculling mode; whereby opposing motions of said oars are combined into a single motion to drive said flywheel; and wherein said drive mechanism comprises at least one oar cradle having rotational freedom about said outrigger, said at least one oar cradle having a drive shaft connected to a drive gear with a bevel gear interchangeably engaging a first bevel gear and a second bevel gear on an output shaft to operate said apparatus in a sweeping mode or a sculling mode; and wherein said output shaft is associated with a third bevel gear for meshing with a fourth bevel gear keyed to a flywheel shaft coupled to said flywheel.

In another of its aspects, there is provided a drive mechanism for a rowing apparatus comprising:

at least one oar cradle having rotational freedom about said outrigger, said at least one oar cradle having a drive shaft connected to a drive gear;

an intermediate pinion engaging said drive gear and interchangeably engaging a first bevel gear and a second bevel gear on an output shaft at either end to adapt said apparatus between a sweeping mode and a sculling mode; and wherein said output shaft is associated with a third bevel gear for meshing with a fourth bevel gear keyed to a flywheel shaft coupled to said flywheel.

Accordingly, the apparatus provides a full range of required movements for simulating rowing on water, including the technical subtleties for rowing on water, and increases general fitness.

Advantageously, the apparatus is easily adaptable to simulate the sweeping or sculling rowing motion characteristics of a rowing or sculling shell, and imparts a resistance to the pull of oars similar to that experienced when rowing on water. In addition, the rowing apparatus is less complex in design and is relatively inexpensive. Another feature of the apparatus is that actual oars may be used, and these oars may be ejected from the oar locks when an improper rowing form is performed by the rower, as is possible when rowing on water.

Another advantage of one aspect of the invention is that the resistance means is provided by a permanent magnetic brake. Accordingly, the drive mechanism can operate without an external power source, actuator or controls. The braking system's reliance on the magnetic force between the magnetic member and the flywheel reduces the level of contact between moving parts when compared to any of a friction-type braking system, a hydraulic type, or an air resistance type. By reducing the level of contact between the braking system components there is less component wear, which translates to reduced maintenance costs. In addition, the apparatus is relatively quiet in operation compared to the prior art rowing machines.

BRIEF DESCRIPTION OF THE DRAWINGS

Several preferred embodiments of the present invention will now be described, by way of example only, with reference to the appended drawings in which.

DETAILED DESCRIPTION OF EXEMPLARY EMBODIMENTS

The detailed description of exemplary embodiments of the invention herein makes reference to the accompanying block diagrams and schematic diagrams, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Figure 1A:
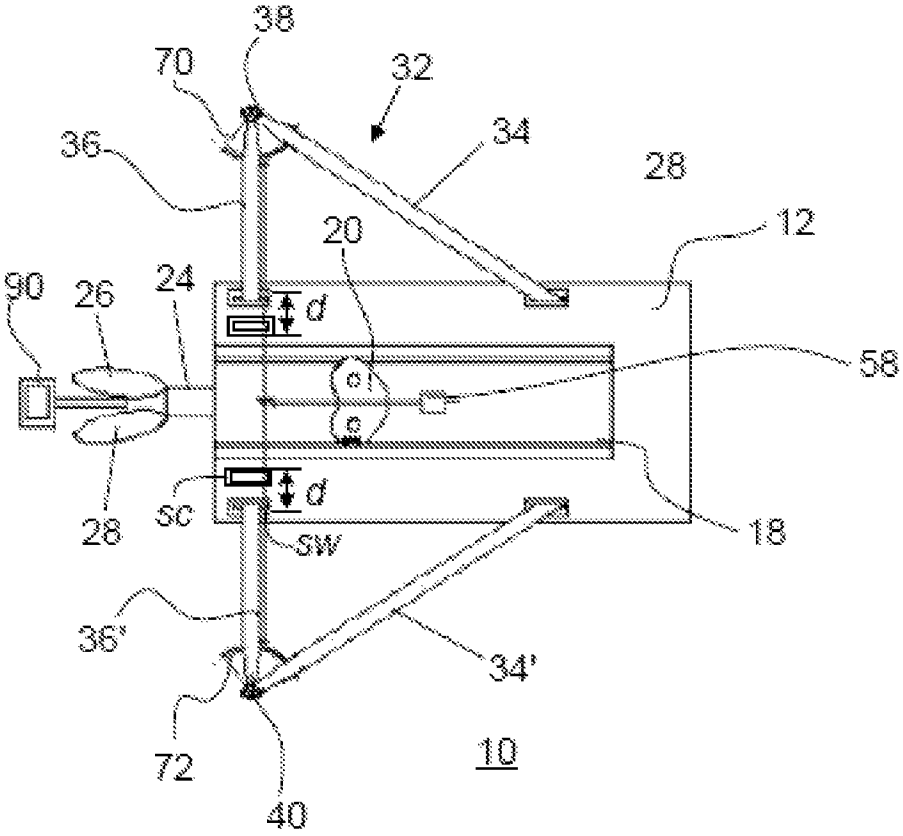
FIG. 1*a* shows a top view of an exemplary rowing apparatus according to an embodiment of this invention.
Figure 1C:
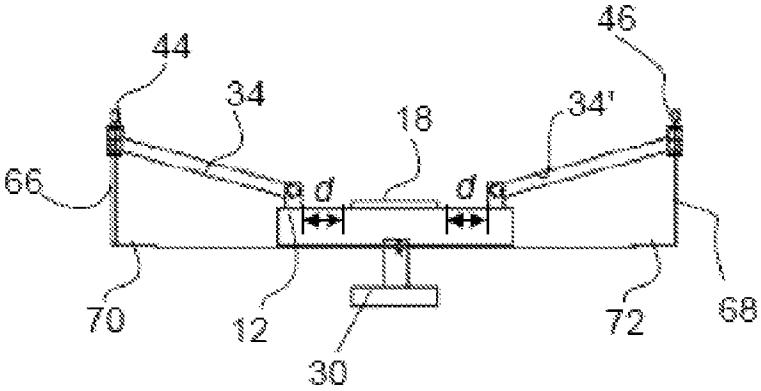
FIG. 1*c* shows a back view of the rowing apparatus.
Figure 1B:
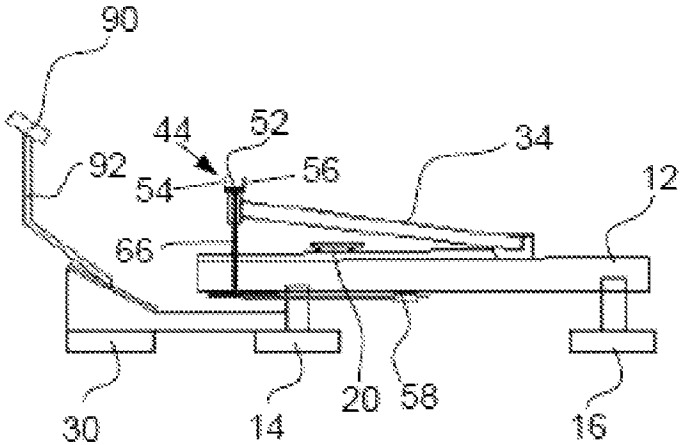
FIG. 1*b* shows a side view of the rowing apparatus.

FIGS. 1*a* to 1*c* show an exemplary rowing simulator apparatus 10 having a horizontal frame identified generally by the reference numeral 12, resting on a front transverse foot 14 adjacent to the proximal end of the frame 12, and a rear transverse foot 16 adjacent to the distal end of the frame 12. The transverse feet 14 and 16 rest on a ground plane and minimize any rocking motion of the apparatus 10 when in operation. The frame 12 comprises at least one longitudinal track 18 having a seat 20 moveably mounted thereon for smooth, continuous back and forth movement. Accordingly, the seat 20 includes rollers 22 which engage and move along the longitudinal track 18. Extending from the front transverse foot 14 is a horizontal member 24 having a pair of adjustable foot rests 26, 28 mounted at opposite sides at one end of the horizontal member 24. For added stability, the end of the horizontal member 24 comprises another transverse foot 30. The horizontal frame 12 is inclined, such that the distal end of the frame 12 is positioned higher than the proximal end of the frame 12, relative to the ground plane. Accordingly, the track 18 is also inclined at the same angle as the frame 12, by virtue of being disposed thereon. The inclination angle of the track 18 thus facilitates the return of the seat 20 to the starting position of the rowing stroke, and provides a balanced exercise motion which simulates a smooth, continuous rowing motion. In one exemplary embodiment, the inclination angle of the track 18 is 5°.

Figure 3A:
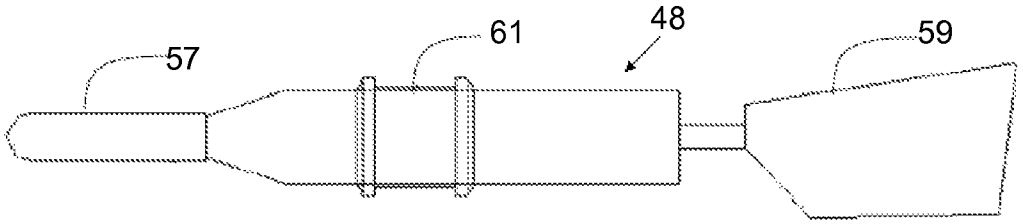
FIGS. 3*a* and 3*b* show an exemplary oar for use with the rowing apparatus.
Figure 3B:
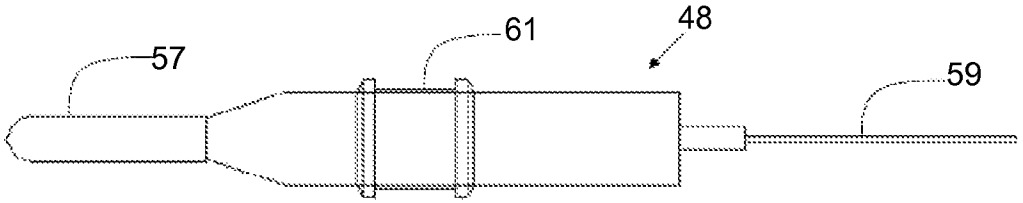

The frame 12 also comprises a modified rowing outrigger 32 with identical tubular arm pairs 34, 36 and 34', 36' mounted on the frame 12, and extending outwardly away from the frame 12. The arms 34, 36 and 34', 36' each have one end hingedly affixed to the frame 12, while the other extremities of arms 34, 36 and 34', 36' support hinged oar locks 38, 40 in sockets 42 (not shown) in the extremities thereof. The oar locks 38, 40 comprise oar cradles 44, 46 pivotally attached thereto, for receiving a pair of oars 48, 50. Each of the oar cradles 44, 46 is generally U-shaped comprising a base 52 with a pair of upwardly-projecting yoke-arms 54, 56 which retain the oars 48, 50. Generally, oar 48 or 50 is an elongate member comprising an oar handle 57 at one end, and a blade 59 at the other end, and a double oar collar 61 therebetween, as shown in FIGS. 3*a* and 3*b*. For example, the double oar collar 61 is received by the oar cradle 44, and the oar 48 is retained within the oar cradle 44 through the various rowing stages, but may be ejected from the oar cradle 44 when an improper rowing form is being performed, as occurs in actual, non-simulated rowing. Conventional oars 48, 50 may be used with the apparatus 10; however, shortened conventional oars 48, 50 dimensioned to fit the rowing apparatus 10's dimensions may also be suitable.

Figure 2C:
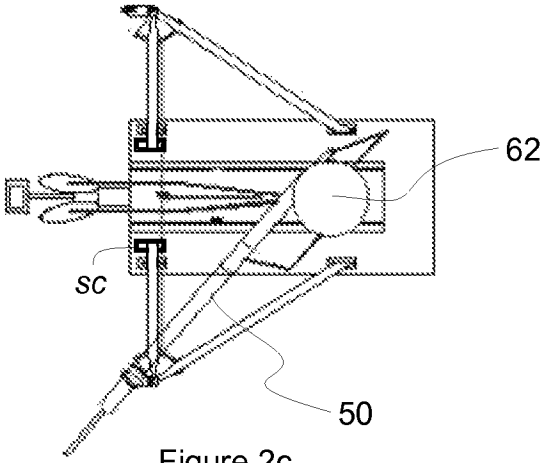
FIGS. 2*c* and 2*d* show the rowing apparatus in a sweeping configuration.
Figure 2D:
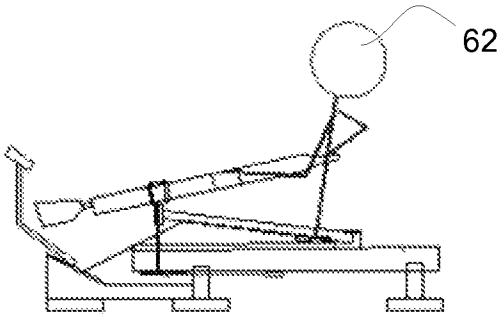
Figure 2A:
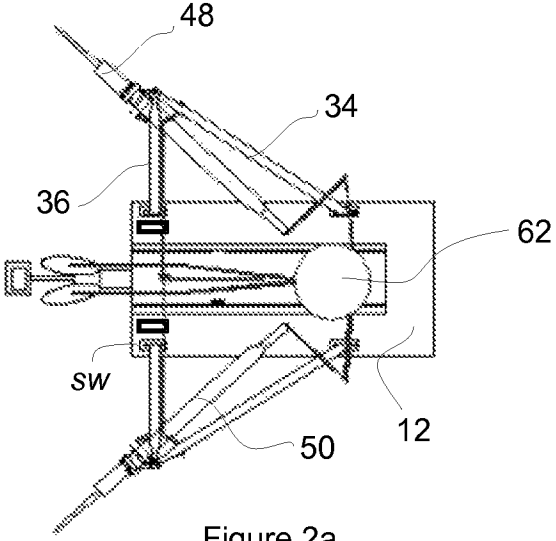
FIGS. 2*a* and 2*b* show the rowing apparatus in a sculling configuration.
Figure 2B:
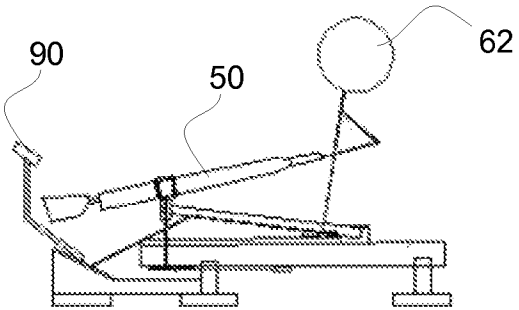

Looking at FIGS. 1*a* and 1*c*, the arm 34 is located adjacent to the distal end of frame 12, while arm 36 is located adjacent to the proximal end of the frame 12, as shown in FIG. 1. The end of arm 36 can be affixed at two locations "sc" and "sw" on the frame 12 to adapt rigger 32 of the apparatus 10 between a sculling mode in which two oars 48, 50 are used, as seen in FIGS. 2*a* and 2*b*, and a sweeping mode in which only one oar 48 or 50 is used, as can be seen in FIGS. 2*c* and 2*d*. Turning to FIG. 3, the two locations sc, sw lie along a common plane and are separated by a distance "d", with one location being closer to the edge of the frame 12. In one exemplary embodiment, the location sw closest to the edge of the frame 12 corresponds to the sweeping mode, while the location sc furthest from the edge of the frame 12 corresponds to the sculling mode. The rowing motion imparted to the oars 48, 50 is transmitted to a flywheel assembly 58 via a drive mechanism 60. As will be described in greater detail below, the drive mechanism 60 comprises a plurality of gears, shafts, and resistance means to simulate water resistance when rowing on water. As can be seen in FIG. 1*c*, the arms 34, 36 extend upward away from the frame 12 to provide sufficient clearance between the drive mechanism 60 and the ground plane, and to place the oar cradles 44, 46 at the desired rowing position relative to a seated rower 62.

Figure 4:
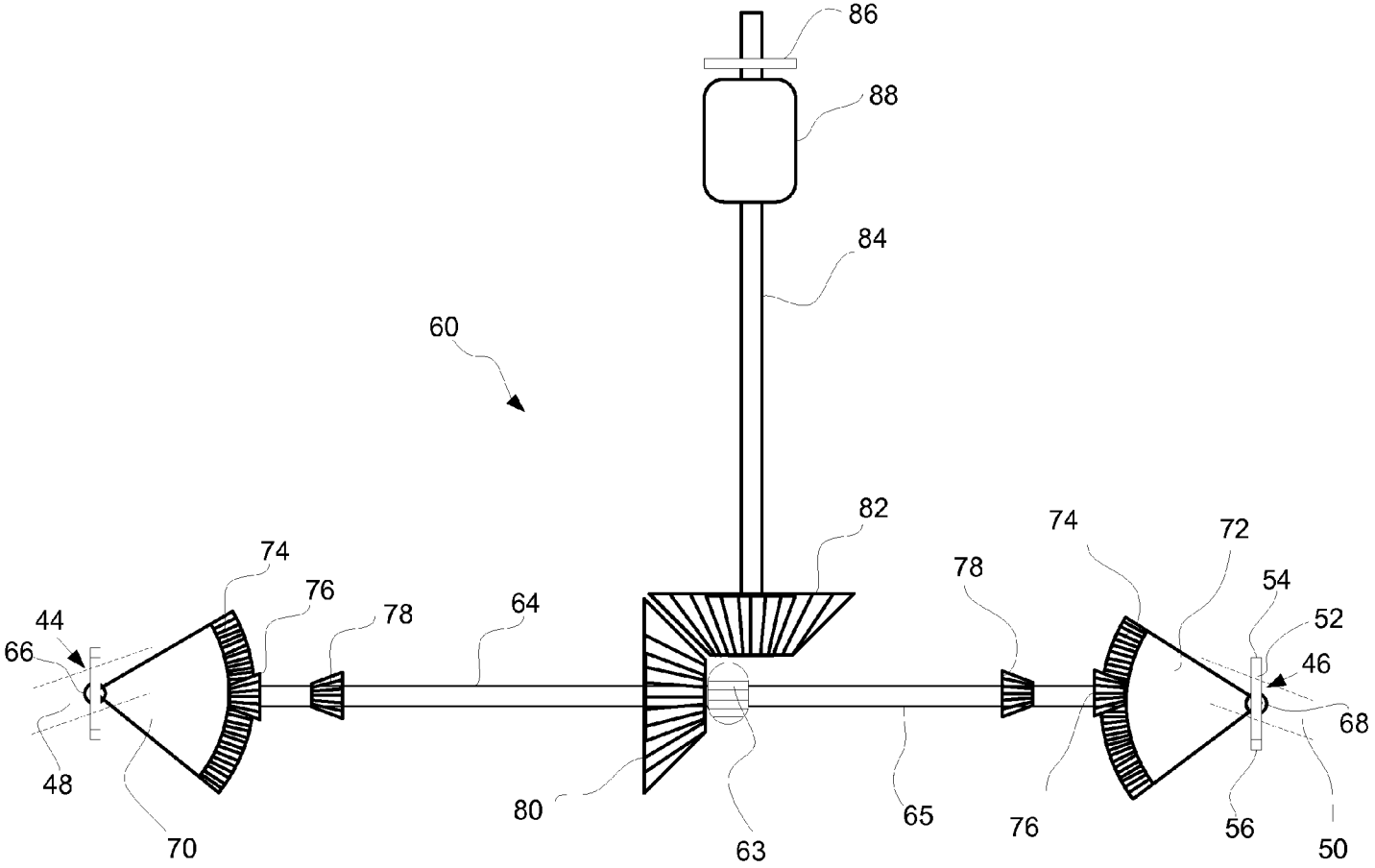
FIG. 4 shows an exemplary drive mechanism.

As shown in FIG. 4, the drive mechanism 60 includes a one way clutch 63 keyed to an output shaft with portions 64, 65 that are rotationally coupled to drive shafts 66, 68 linked to the oar cradles 44, 46. The oar cradles 44, 46 are provided with rotational freedom about the outrigger 32, and are connected to drive gears, such as bevel segment gears 70, 72 via drive shafts 66, 68 extending downwardly from the base 52 of oar cradles 44, 46. The drive shafts 66, 68 thus rotate in a substantially vertical axis and cause the bevel segment gears 70, 72 to rotate about a substantially horizontal axis. Bevel segment gear 70 or 72 is in the form of a circular arc and comprises a bevel gear 74 with a plurality of individual tooth elements arranged in succession. In one example, the bevel segment gears 70, 72 span a center-angle of 120°. The bevel gear 74 tooth elements engage tooth elements of one of bevel gear pairs 76, 78 on output shaft portions 64, 65. From each pair, the bevel gear 76 corresponds to a sweeping mode, while the bevel gear 78 corresponds to a sculling mode. Affixed halfway between the two bevel gears 78 is a central bevel gear 80, and the one way clutch 63. The teeth of central bevel gear 80 engage the teeth of another bevel gear 82 keyed to a flywheel shaft 84 linked to a flywheel 86. Accordingly, the pulling action on the oars 48, 50 by the rower 62 causes partial rotation of the drive shafts 66, 68, in opposing directions, and the pulling force is imparted to the drive mechanism 60. The bevel gear arc 70 or 72 is forced into reciprocating motion in the horizontal plane, such that bevel gear 74 transmits that motion to the bevel gear 76 or 78 on output shaft portion 64 or 65. The central bevel gear 80 therefore rotates in sympathy to the motion of the output shaft portion 64 or 65. The teeth of central bevel gear 80 engage the teeth of bevel gear 82 keyed to the flywheel shaft 84 which rotates a flywheel 86 of the flywheel assembly 58, as shown in FIG. 4. In one exemplary embodiment, the bevel gear 74, bevel gear pairs 76, 78, central bevel gear 80 and bevel gear 82 may be spiral, helical or hypoid, and may include varying pitch angles, and gear ratios.

The rotational motion of the flywheel 86 in combination with the magnetic break 88 simulates the resistance forces that slow down an actual boat moving in a fluid, such as skin drag, due to friction between the hull entraining water along with the hull; form drag, due to turbulence created by the passage of the hull; and wave drag, due to energy lost in creating waves. Accordingly, the rowing apparatus 10 duplicates the typical arrangement of a rowing boat and can thus be used to teach rowing techniques, training, or as exercise or for measuring and recording individual performance.

In more detail, the sweeping mode bevel gear 76 is located at the end of output shaft portions 64, 65, while the sculling mode bevel gear 78 is between the sweeping mode bevel gear 76 and the central bevel gear 80, such that the two gears 76, 78 are separated by a distance "d". Accordingly, when the arms 36, 36' is affixed to location sw, then the bevel arc gear 70 teeth engages the sweeping mode bevel gear 76 teeth, thus placing the apparatus 10 into a sweeping mode. Correspondingly, the apparatus 10 is adapted to operate in a sweeping mode by affixing the arms 36, 36' to location sc, thereby engaging the bevel arc gear 70 teeth with the sculling mode bevel gear 78 teeth. The one way clutch 63 ensures that only a pulling motion of the oars 48, 50 will cause the flywheel assembly 58 to be driven and the flywheel 86 will free wheel, subject to the resistance of the eddy-current brake, during the recovery part of the stroke when the oars 48, 50 are retracted. Accordingly, the motions of the oars 48, 50 are combined into a single force to cause unidirectional rotation of the flywheel 86, thus mimicking the true action of rowing a boat on water. The flywheel assembly 58 includes a magnetic break 88 which provides variable resistance to the rower 62. The resistance is adjustable and is provided without the need for external power sources, actuators or controls. An exemplary magnetic break 88 comprises at least one permanent magnet.

Figure 5A:
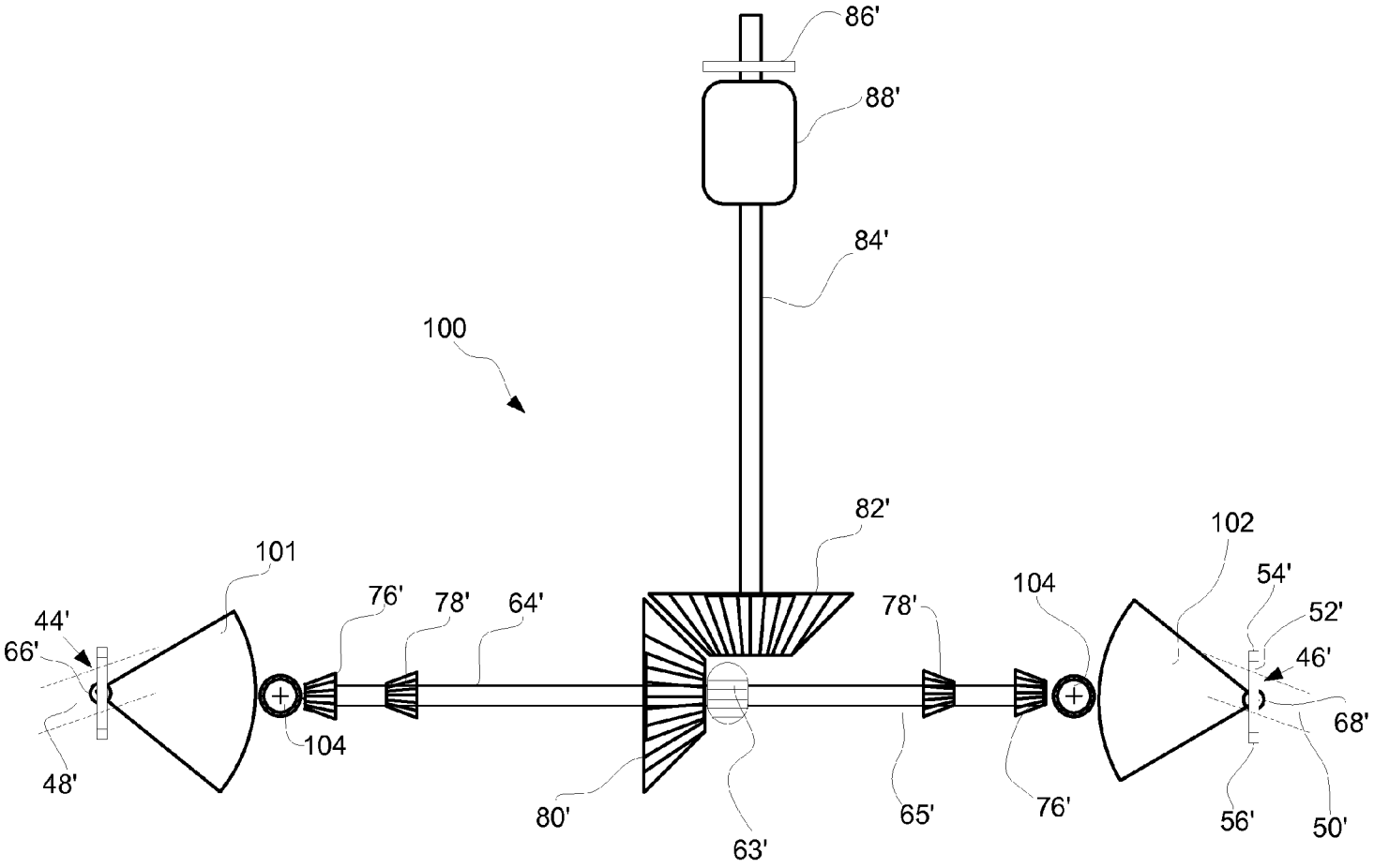
FIGS. 5*a* and 5*b* show another exemplary drive mechanism, in another exemplary embodiment.
Figure 5B:
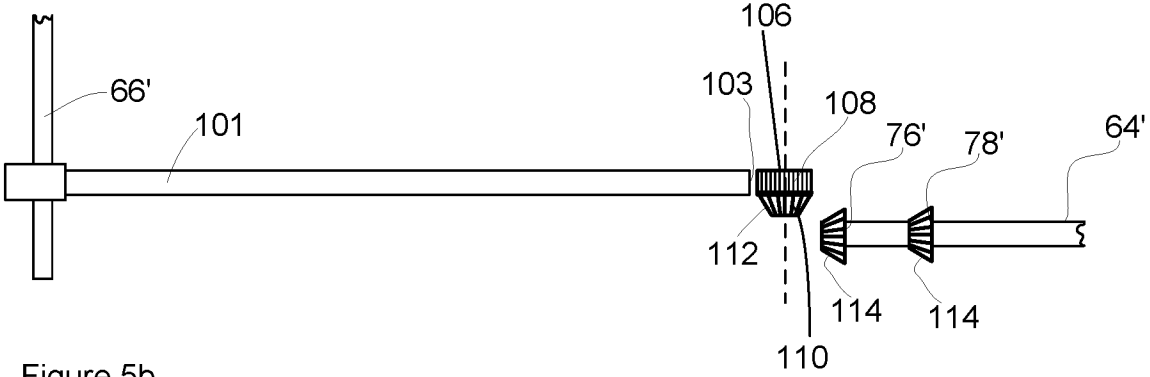

In operation, the rower 62 sits on the seat 20 and the rower's 62 feet are pushed against the foot rests 26, 28; with legs compressed, arms extended and hands grasping the oars 48, 50, corresponding to a catch position, as shown in FIGS. 5*a* and 5*b*. The foot rests 26, 28 are provided for positioning of the rower 62's feet, and preferably, the foot rests 26, 28 have heel rests and foot restraints to secure the rower 62's feet against the foot rests 26, 28 as the rower 62 moves longitudinally with the sliding seat 20 during the rowing strokes. In this position, the seat 20 is slid adjacent to one end of the track 18 near the proximal end of the frame 12. The oar 48 or 50 acts as a lever with the oar cradle 44 or 46 acting as the fulcrum, with the pulling force being applied on the oar handle 57, and the load, typically on the blade 59 of the oar 48 or 50, being provided by the resistance means, in the form of the magnetic break 88. In the sculling mode, as shown in FIGS. 2*a* and 2*b*, the seat 20 moves along the track 18 extending from the proximal end of the frame 12 to about the middle of the frame 12. As the rower 62 transforms to the drive position, the rower 62's legs are nearly extended and the arms start to bend. In the drive position, the maximum transfer of effort is applied to the oars 48, 50 and transferred to the bevel gear arc 70 to drive the flywheel assembly 58. FIGS. 2*a* and 2*b* illustrate the drive position, in which the seat 20 has now been forced to about the mid-point of the track 18. At the end of the rowing stroke, the finish position, the rower 62's legs are extended, the arms bent and the oar handles are at the rower 62's side, and the seat 20 is adjacent to the other end of the track 18. During the recovery part of the stroke, as the rower 62 returns to the catch position, the one way clutch 63 does not engage, such that the drive mechanism 60 does not drive the flywheel 86. In the sweeping mode, only one of the oars 48 or 50 is used, as shown in FIGS. 2*c* and 2*d*.

A monitor or speed coach 90 is mounted adjacent to the proximal end of frame 12 on a mount 92. The monitor 90 provides feedback to the rower 62 regarding the rowing activity, and facilitates real-time performance evaluation. Accordingly, the monitor 90 includes a power source, and may be coupled to a processing means and a computer readable medium comprising instructions to output statistics pertaining to the rowing activity, such as elapsed time, distance, speed, stroke rate, resistance, energy expended, and memory recall for performance review, among other features. An accelerometer is associated with the flywheel 86 to sense velocity or measure the rotational speed of the flywheel 86, and to determine acceleration. Another accelerometer is associated with the seat 20 monitors the acceleration of rower's seat 20, and provides this information to the monitor 90. The monitor 90 also allows for data input pertaining to the rower 62's training or exercise preferences, target heart rates, goals (distance or time), including the rower 62's characteristics, such as age, weight, and so forth.

In another embodiment, the apparatus 10 comprises a means for manually controlling the level of resistance via a control coupled to the magnetic break 88, and the total range of resistance may be numbered for quick reference, with the low range signifying a lower resistance, while the higher range corresponds to higher resistance. For example, different ranges of resistance may be set for sculling and sweeping.

In another embodiment, the outrigger 32 is hingedly mounted to the frame 12, such that the tubular arms 34, 36, 34', 36' may be swung to be longitudinally disposed and substantially parallel to the frame 12 for storage or transport.

In another embodiment, the outrigger 32 is hingedly mounted to the frame 12 such that the height of the outrigger 32 is adjustable by moving the tubular arms 34, 36, 34', 36' up or down relative to the ground plane.

In another embodiment, the frame 12, seat 20, and oar assemblies 48, 50 may be made of an alloy, aluminum, steel, or may be made in whole or in part of a plastic material, with suitable reinforcement.

In yet another embodiment, the seat 20 is anatomically contoured so as to provide a comfortable seat 20 for the rower 62. The seat 20 is cushioned and is preferably made of a high-density resilient foam material, and may include a rear support portion to provide support for the rower 62's lower back.

In another embodiment, the angle of inclination of the frame 12 and track 18 is adjustable.

In yet another embodiment, the apparatus 10 is adapted to accommodate more than one rower 62, such as a crew of two, four or eight rowers 62. When rowing on water, precise coordination of rowers 62 is desired so that the boat moves quickly and efficiently, otherwise the lack of synchronicity checks the boat and wastes energy. Accordingly, the apparatus 10 comprises a plurality of outriggers 32, and a plurality of drive mechanism units 60 that may be coupled to provide a combined torque to the flywheel assembly 58. The accelerometer associated with each individual seat 20 monitors the acceleration of each rower's seat 20 and this information is analysed to detect flaws in synchrony. Alternatively, each rower 62 is associated with their own drive mechanism unit 60 such that each rower 62's performance can be individually monitored; and the aggregate data from all the rowers 62 can be acquired and analysed.

In another embodiment, drive gear 70 or 72 comprises a ring or a partial ring having gear portion with spokes extending from either end of the gear portion and meeting at a hub with drive shaft 66 or 68.

In yet another embodiment, as shown in FIGS. 5*a* and 5*b*, apparatus 10 includes drive mechanism 100 similar to drive mechanism 60, and therefore includes similar or identical parts. Drive mechanism 100 includes a one way clutch 63' keyed to output shaft portions 64', 65' that are rotationally coupled to drive shafts 66', 68' linked to oar cradles 44', 46'. The oar cradles 44', 46' are provided with rotational freedom about the outrigger 32' (not shown), and are connected to drive gears, such as spur gear arcs 101, 102 comprising with teeth 103 via drive shafts 66', 68' extending downwardly from the base 52' of oar cradles 44', 46'. The drive shafts 66', 68' thus rotate in a substantially vertical axis and cause spur gear arcs 101, 102 to rotate about a substantially horizontal axis. Drive gear 101 or 102 may comprise a disc having spur gear teeth 103, or a partial disc having spur gear teeth 103.

An intermediate pinion 104 rotationally couples spur gear arcs 101, 102 to output shaft portion 64' or 65'. Generally, intermediate pinion 104 is a combined spur and bevel pinion comprising a spur gear 106 with teeth 108 and bevel gear 110 with teeth 112. Teeth 108 of pinion 104 engage teeth 103 of spur gear arcs 101, 102, and teeth 112 of bevel gear 110 engage teeth 114 of bevel gear pairs 76', 78' on output shaft portions 64', 65'. The transmission ratio between the segment gear 101 or 102 and the spur gear 106 is dictated by the number of teeth on the respective gears 101 or 102 and 106. In one example, the transmission ratio is approximately 25:1. Spur gear arcs 101, 102 may be formed from a disc, or fabricated as a disc portion or cut-out. For example, bevel segment gear 70 or 72 may be in the form of a circular arc spanning a center-angle of 120°. In one example, intermediate pinion 104 comprises a 1" Ø spur gear 106 with teeth 108 and 1" Ø bevel gear 110 with teeth 112 which engage teeth 114 of 1" Ø bevel gear pairs 76', 78' on ½ Ø output shaft portions 64', 65'.

From each pair, the bevel gear 76' corresponds to a sweeping mode, while the bevel gear 78' corresponds to a sculling mode. Affixed halfway between the two bevel gears 78' is a central bevel gear 80', and the one way clutch 63'. In turn, the teeth of central bevel gear 80' engage the teeth of another bevel gear 82' keyed to a flywheel shaft 84' linked to a flywheel 86'. Accordingly, the pulling action on the oars 48', 50' by the rower 62' (not shown) causes partial rotation of the drive shafts 66', 68', in opposing directions, and the pulling force is imparted to the drive mechanism 60. The spur gear arc 101 or 102 is forced into reciprocating motion in the horizontal plane, such that its spur gear teeth 103 transmits that motion to the spur gear teeth 108 on pinion 104, and that rotational motion causes motion of output shaft portion 64' or 65' as bevel teeth 110 intermesh with teeth 114 of bevel gear pairs 76', 78'. The central bevel gear 80' therefore rotates in sympathy to the motion of the output shaft portion 64' or 65'. The teeth of central bevel gear 80' engage the teeth of bevel gear 82 keyed to the flywheel shaft 84' which rotates a flywheel 86' of the flywheel assembly 58'. Bevel gear pairs 76', 78', central bevel gear 80' and bevel gear 82' may be spiral, helical or hypoid, and may include varying pitch angles, and gear ratios.

Figure 5C:
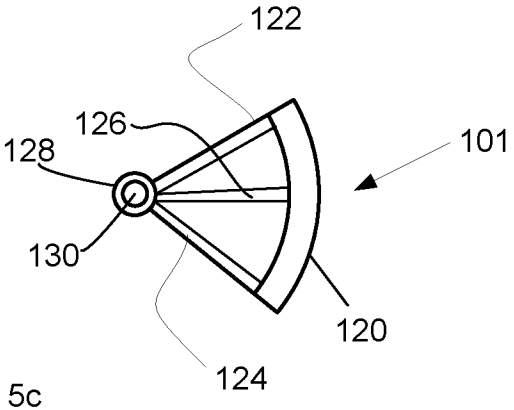
FIG. 5*c* shows a drive gear, in another exemplary embodiment.

In another embodiment, drive gear 101 or 102 comprises a partial ring having gear portion 120, with spokes 122, 124 extending from either end of a gear portion 120, and spoke 126 extending from a mid-point of gear portion 120, and meeting at hub 128 having a bore 130 for receiving drive shaft 66' or 68', as shown in FIG. 5*c*. For example, drive gear 101 or 102 may be in the form of a circular arc spanning a center-angle of 120°, with a radius of 12 inches.

In another embodiment, drive gear 101 or 102 comprises a ring having gear portion 120, with a plurality of spokes extending therefrom and meeting at hub 128 with drive shaft 66' or 68'.

In another embodiment, drive gear 101 or 102 comprises a disc having spur gear teeth 103, or a partial disc having spur gear teeth 103.

Drive gear 101 or 102 may comprise a straight spur gear or a helical spur gear.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The embodiments of the invention in which an exclusive property or privilege is claimed are defined as follows:

1. A rowing apparatus having:
a frame;
a seat slidably mounted on said frame;
an outrigger for receiving oars;
at least one drive mechanism coupled to said outrigger to translate a force applied to said oars to a flywheel having resistance means for providing variable resistance;
said rowing apparatus having a one way clutch for unidirectional rotary drive of said flywheel, and allowing for operation in a sweeping mode or a sculling mode;
whereby the opposing motions of said oars are combined into a single motion to drive said flywheel;
wherein said at least one drive mechanism comprises two oar cradles having rotational freedom about said outrigger, each of said oar cradles having a drive shaft connected to a drive gear for imparting motion to an output shaft rotationally coupled to a flywheel shaft rotationally coupled to said flywheel; and
wherein said drive gear is a spur gear engaging an intermediate pinion which engages an output gear on said output shaft.

2. The rowing apparatus of claim 1, wherein said drive gear comprises a drive spur gear portion.

3. The rowing apparatus of claim 2, wherein said intermediate pinion comprises a spur gear member and a bevel gear member.

4. The rowing apparatus of claim 3, wherein said spur gear member engages said drive spur gear portion.

5. The rowing apparatus of claim 4, wherein said bevel gear member engages a complementary bevel gear arrangement on said output shaft.

6. The rowing apparatus of claim 5, wherein said drive gear is formed of at least one of a disc and a disc portion.

7. The rowing apparatus of claim 6, wherein said disc portion is in the form of a circular arc.

8. The rowing apparatus of claim 5, wherein said drive gear comprises a ring having a spur gear portion with at least two spokes extending therefrom and meeting at a hub connected to said drive shaft.

9. The rowing apparatus of claim 5, wherein said drive gear comprises a partial ring having a spur gear portion with at least two spokes extending therefrom and meeting at a hub connected to said drive shaft.

10. The rowing apparatus of claim 9, wherein said partial ring is in the form of a circular arc.

11. The rowing apparatus of claim 5, wherein said complementary bevel gear arrangement comprises a first bevel gear and a second bevel gear at either end, for interchangeably engaging said bevel gear member of said intermediate pinion to adapt said apparatus between a sculling mode and a sweeping mode.

12. The rowing apparatus of claim 11, wherein said output shaft is associated with a third bevel gear for meshing with a fourth bevel gear keyed to a flywheel shaft rotationally coupled to said flywheel.

13. The rowing apparatus of claim 12, wherein a transmission ratio between said drive gear and said intermediate pinion is approximately 25:1.

14. The rowing apparatus of claim 11, wherein said resistance means comprises a magnetic break having a permanent magnet.

15. A rowing apparatus having:

a frame;

a seat slidably mounted on said frame;

an outrigger for receiving oars;

at least one drive mechanism coupled to said outrigger to translate a force applied to said oars to a flywheel having resistance means;

a one way clutch for unidirectional rotary drive of the flywheel, and allowing for operation in a sweeping mode or a sculling mode; whereby opposing motions of said oars are combined into a single motion to drive said flywheel; and wherein said drive mechanism comprises at least one oar cradle having rotational freedom about said outrigger, said at least one oar cradle having a drive shaft connected to a drive gear with a bevel gear interchangeably engaging a first bevel gear and a second bevel gear on an output shaft to operate said apparatus in a sweeping mode or a sculling mode; and wherein said output shaft is associated with a third bevel gear for meshing with a fourth bevel gear keyed to a flywheel shaft coupled to said flywheel.

16. The rowing apparatus of claim 15, wherein said drive gear comprises at one least of a disc having said bevel gear and a partial disc having said bevel gear.

* * * * *